United States Patent [19]

McDonough

[11] 3,942,860

[45] Mar. 9, 1976

[54] CONNECTOR ASSEMBLY

[75] Inventor: Cletus G. McDonough, Elmhurst, Ill.

[73] Assignee: Molex Incorporated, Lisle, Ill.

[22] Filed: Oct. 4, 1974

[21] Appl. No.: 512,179

[52] U.S. Cl. ..... 339/217 S; 339/252 P

[51] Int. Cl.[2] ..... H01R 9/08

[58] Field of Search ..... 339/217 R, 217 S, 176 M, 339/258 R, 258 P, 252 R, 252 P, 19, 222, 47 R, 48, 49 R, 49 B

[56] References Cited

UNITED STATES PATENTS

| | | | |
|---|---|---|---|
| 3,083,345 | 3/1963 | Scheller | 339/47 R |
| 3,193,795 | 7/1965 | Krehbiel | 339/217 S |
| 3,209,308 | 9/1965 | Aquillon | 339/176 M |
| 3,218,605 | 11/1965 | Waylass | 339/258 R |
| 3,555,494 | 1/1971 | Baumanis | 339/217 S |

*Primary Examiner*—Joseph H. McGlynn
*Assistant Examiner*—James W. Davie
*Attorney, Agent, or Firm*—Louis A. Hecht

[57] ABSTRACT

A push-type terminal connector assembly including a terminal housing made of insulating material and with a terminal receiving receptacle adapted to receive a plurality of terminals and a plurality of like terminals each adapted to be plugged into the terminal receiving receptacle. The housing has a plurality of channels formed in the receptacle for transversely dividing the receptacle into a plurality of adjacent terminal receiving stations. A detent ridge is provided in the interior of the receptacle and is adapted to engage a portion of the terminal for positioning and holding the terminal at a receiving station at a given depth. Each terminal includes a lateral compressible contact spring adapted to electrically connect and press against the contact springs of another terminal plugged in an adjacent receiving station. Each terminal also includes stop tangs and a detent spring for cooperation with the detent ridge so that the detent ridge is captured therebetween for positioning and holding the terminal in the receptacle at a given depth.

6 Claims, 6 Drawing Figures

FIG. 1
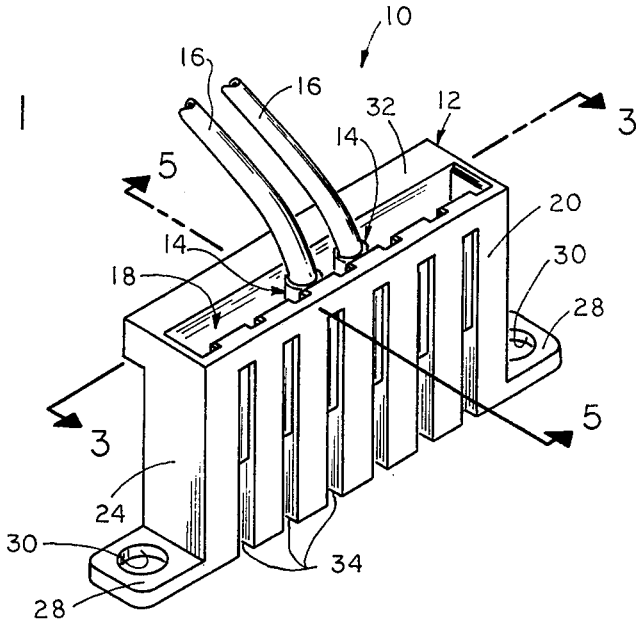
FIG. 2
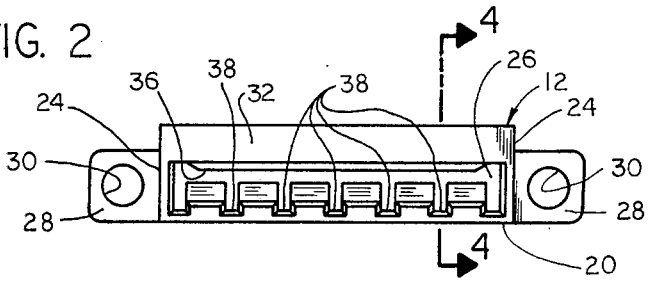
FIG. 6
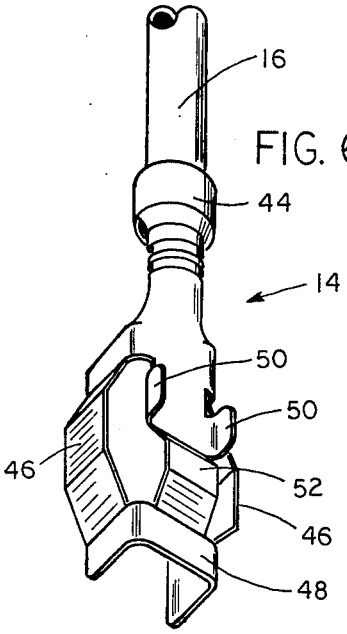
FIG. 3
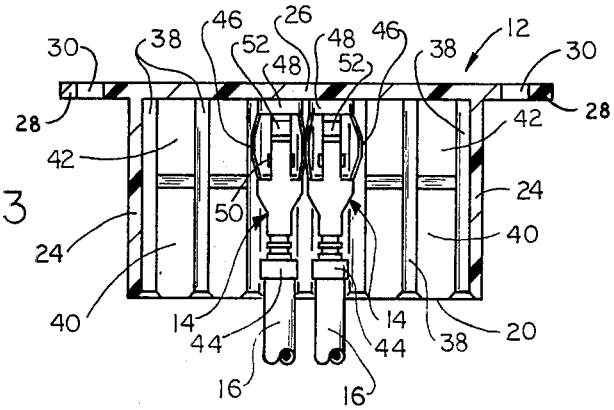
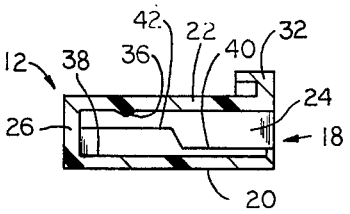
FIG. 4
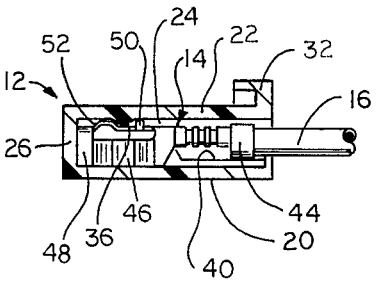
FIG. 5

CONNECTOR ASSEMBLY

BACKGROUND OF THE INVENTION

1. Field of the Invention

The present invention relates to electrical connectors and, more particularly, to connectors of the type that provide a common electrical connection between a plurality of terminals.

2. Brief Description of the Prior Art

Commoning block connectors are conventionally used to electrically connect the plurality of inputs or outputs. However, commoning blocks can be used to merely position one terminal with respect to another so as to insure proper electrical connection.

A problem encountered in commoning block connectors in the prior art is the necessity of providing a plurality of separate metal interior terminals mounted integrally in the block. The interior terminals are then electrically connected to one another. In order to electrically connect a wire to the commoning block, another terminal is required to be crimped on the end of the wire. The wire terminal then contacts the interior terminal when pushed in the commoning block. However, the provision of two sets of terminals has proven costly.

Some designs have avoided the use of two sets of terminals by eliminating the interior terminals, as exemplified by U.S. Pat. No. 3,193,795. The wire terminals in such designs have a single portion thereof cooperating with the interior of a connector housing which positions the terminal within the housing and biases the terminal against an adjacent terminal to insure electrical contact. The fact that the positioning action and biasing action do not occur independently of each other offers the disadvantage that tolerances become critical.

SUMMARY OF THE INVENTION

It is therefore the principal object of the present invention to provide a push-type terminal connector assembly which positively positions one terminal with to another terminal for electrical connection and is relatively simple in construction and easy and less costly to manufacture.

These and other objects of the invention are accomplished by one form of the invention currently contemplated by providing a housing and a plurality of like terminals. The housing, which is made of insulating material, includes a terminal receiving receptacle adapted to receive a plurality of terminals, a plurality of transverse positioning means associated with such receptacles for dividing said receptacle between plurality of adjacent terminal receiving stations, and detent means adapted to engage a portion of a terminal positioning and holding the terminal in a receiving station at a given depth. Each terminal, which is adapted to be plugged into the terminal receiving stations, includes biasing means adapted to electrically connect and press against the biasing means on a terminal plugged in an adjacent receiving station, and interengaging means cooperating with the detent means for positioning and holding the terminal in the receptacle at a given depth.

BRIEF DESCRIPTION OF THE DRAWINGS

FIG. 1 is a perspective view of the connector assembly of the present invention;

FIG. 2 is a top plan view of the housing comprising a part of the connector assembly of the present invention;

FIG. 3 is a sectional view taken generally along the line 3—3 of FIG. 1;

FIG. 4 is a sectional view taken generally along the line 4—4 in FIG. 2;

FIG. 5 is a sectional view taken generally along the line 5—5 in FIG. 1; and

FIG. 6 is an enlarged perspective view of a terminal comprising a part of the connector assembly of the present invention.

DESCRIPTION OF THE PREFERRED EMBODIMENT

Turning now to FIG. 1 in greater detail, the connector assembly, generally designated 10, is seen to generally include a housing, generally designated 12, and a plurality of terminals, generally designated 14, which are electrically connected to a circuit by means of wire 16. The terminals 14 are receivable in a rectangular cross-sectioned slot, generally designated 18, formed in housing 12 defining a terminal receptacle.

The housing 12 includes a front wall 20, a rear wall 22, two side walls 24, and a bottom wall 26. A pair of mounting ears 28 are formed on either side of side walls 24 as an extension of bottom wall 26. Each mounting ear 28 has an opening 30, formed therein to receive a fastener therethrough so that the housing 12 can be secured to a suitable surface. A lip 32 is provided at the top of rear wall 22 to provide rigidity in the housing 12. Coring 34 is provided in front wall 20, to reduce manufacturing costs.

The interior of receptacle 18 has a detent ridge 36 formed on the interior of rear wall 22. The interior of front wall 20 has a plurality of spaced apart, parallel channels 38, formed therein running in a direction perpendicular to the detent ridge 36, The channels 38 are separated by a plurality of bars 40, having a raised portion 42 near the interior of the bottom wall 26. Two successive channels 38, and the intermediate bar 40 and raised portion 42 defines a terminal receiving station. Thus, the receptacle 18 is divided into a plurality of adjacent terminal receiving stations.

Turning now to FIG. 6 in greater detail, the terminal 14 used in conjunction with the housing 12 is seen to generally include a crimp section 44 at one end thereof which is crimped onto the end of a wire 16, a pair of laterally outwardly extending compressible contact springs 46, and a generally U-shaped cross-sectioned end 48. A pair of stop tangs 50 and a detent spring 52, are formed between the contact springs 46.

In order to mount terminal 14 in the terminal receptacle 18, the leg portions of the U-shaped end 48 are received into adjacent channels 38. The terminal 14 is then pushed toward bottom wall 26. Channels 38 serve to guide the terminal 14 toward bottom wall 26. When the terminal 14 is fully inserted, detent ridge 36 is snap fit between stop tangs 50 and detent spring 52 as best shown in FIG. 5. This positions terminal 14 at a given depth in housing 12. If it is desired that a terminal be held at a less depth, all that is required is to form the detent ridge 36 closer to the top of the housing 12.

In order to connect another terminal 14 to a terminal which is already inserted within the housing 12 all that need be done is to insert that terminal in the manner described above. Electrical contact is insured because contact spring 14 extends more than half the width of any particular channel 38. Therefore, when another terminal is inserted in the adjacent receiving station, the contact springs 46 of the adjacent terminals 14 will interfere with one another causing compression of the contact springs toward their respective terminals 14.

Terminals 14 can be inserted in pairs or any number that is desired and will be in electrical contact with each other as long as they occupy adjacent terminal receiving stations. If desired, the connector assembly 10 of the present invention can also be used to electrically connect a plurality of separate circuits. For example, three sets of terminals can be electrically connected to one another within each set but out between the sets by merely leaving a receiving station unoccupied between each set of terminals.

It should be understood that it is not necessary to have bottom wall 26 as part of housing 12. The housing can be open at both ends allowing for terminal communication from either end if desired.

Unlike most of the prior art methods of electrically connecting a plurality of terminals together, the configuration of the present invention provides separate means to position a terminal a given depth in the housing and a different means for insuring electrical contact between adjacent terminals.

I claim:

1. A push-type terminal connector assembly comprising:

a terminal housing made of insulating material including a terminal receiving receptacle adapted to receive a plurality of terminals, a plurality of transverse positioning means associated with said receptacle for dividing said receptacle into a plurality of adjacent terminal receiving stations, and detent means adapted to engage a portion of a terminal for positioning and holding a terminal in a receiving station at a given depth; and a plurality of like terminals, each adapted to be plugged into said terminal receiving stations and each including biasing means adapted to electrically connect and press against the biasing means on a terminal plugged in an adjacent receiving station, andd interengaging means cooperating with said detent means for positioning and holding said terminal in said receptacle at a given depth.

2. The connector assembly of claim 1 wherein said transverse positioning means includes a plurality of channels formed in the terminal receiving receptacle, each terminal having a generally U-shaped cross-section, the legs of said cross-section being receivable in said channels.

3. The connector assembly of claim 1 wherein the terminal biasing means includes a pair of compressible contact springs, one on each side of the terminal, each contact spring extending a sufficient distance from said terminal so that it will interfere with the contact spring of a terminal plugged in an adjacent receiving station.

4. The connector assembly of claim 1 wherein said detent means includes a ridge formed in the interior of said terminal receiving receptacle extending generally transverse the direction of terminal insertion, said terminal interengaging means including notch means formed on said terminal for capturing said ridge when inserted into the housing.

5. The connector assembly of claim 4 wherein said notch means includes a forward compressible detent spring and a pair of parallel rearward stop tangs, said detent ridge being positionable between said detent spring and said stop tangs.

6. A push-type terminal connector assembly comprising:

a terminal housing made of insulating material including a terminal receiving receptacle adapted to receive a plurality of terminals, a plurality of channels formed in the terminal receiving receptacle for dividing said receptacle into a plurality of adjacent terminal receiving stations, and a detent ridge formed in the interior of said terminal receiving receptacle extending generally transverse the direction of terminal insertion and adapted to engage a portion of a terminal for positioning and holding a terminal in a receiving station at a given depth; and a plurality of like U-shaped cross-sectioned terminals, each adapted to be plugged into said terminal receiving stations, the legs of said cross-section being receivable in said channels and each terminal including a pair of compressible contact springs, one on each side of the terminal, each contact spring extending a sufficient distance from said terminal and electrically engageable with the contact spring of a terminal plugged in at least one adjacent receiving station, and interengaging means cooperating with said detent ridge for positioning and holding said terminal in said receptacle at a given depth, said interengaging means including a forward compressible detent spring and a pair of parallel rearward stop tangs, said detent ridge being positionable between said detent spring and said stop tangs.

* * * * *